US010321734B2

(12) United States Patent
Conant et al.

(10) Patent No.: US 10,321,734 B2
(45) **Date of Patent: *Jun. 18, 2019**

(54) ARTICLE OF FOOTWEAR WITH HEEL EXTENDER

(71) Applicant: NIKE, Inc., Beaverton, OR (US)

(72) Inventors: Drew Conant, Lake Oswego, OR (US); Anthony P. Daversa, Beaverton, OR (US); Robert Charles Williams, Jr., Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/833,501

(22) Filed: Dec. 6, 2017

(65) Prior Publication Data

US 2018/0092433 A1 Apr. 5, 2018

Related U.S. Application Data

(63) Continuation of application No. 15/063,968, filed on Mar. 8, 2016, now Pat. No. 9,867,426.

(51) Int. Cl.

| | |
|---|---|
| ***A43B 7/14*** | (2006.01) |
| ***A43B 13/18*** | (2006.01) |
| ***A43B 13/12*** | (2006.01) |
| ***A43B 13/04*** | (2006.01) |
| ***A43B 13/22*** | (2006.01) |
| ***A43B 13/14*** | (2006.01) |
| ***A43B 23/30*** | (2006.01) |

(52) U.S. Cl.

CPC ..... *A43B 13/186* (2013.01); *A43B 7/14* (2013.01); *A43B 13/04* (2013.01); *A43B 13/127* (2013.01); *A43B 13/141* (2013.01); *A43B 13/148* (2013.01); *A43B 13/188* (2013.01); *A43B 13/223* (2013.01); *A43B 23/30* (2013.01)

(58) Field of Classification Search

CPC ..... A43B 5/00; A43B 13/00; A43B 13/143; A43B 23/088; A43B 7/14

USPC ..... 36/91, 92, 103, 107, 105, 114, 132, 69, 36/25 R, 72 R, 72 B, 73

See application file for complete search history.

(56) References Cited

U.S. PATENT DOCUMENTS

| | | | | | |
|---|---|---|---|---|---|
| 3,283,423 | A | * | 11/1966 | Schovee | A43B 3/16 36/138 |
| 4,030,213 | A | * | 6/1977 | Daswick | A43B 5/06 36/103 |
| 4,314,413 | A | * | 2/1982 | Dassler | A43B 5/06 36/104 |
| RE31,173 | E | * | 3/1983 | Daswick | A43B 5/06 36/103 |
| 4,402,146 | A | * | 9/1983 | Parracho | A43B 23/17 36/129 |

(Continued)

*Primary Examiner* — Marie D Bays

(74) *Attorney, Agent, or Firm* — Quinn IP Law

(57) ABSTRACT

An article of footwear includes a sole structure that has a heel portion with a rear, a lateral side, and a medial side. The article of footwear includes a heel extender that has a rear segment disposed at the rear of the heel portion, a lateral arm disposed at the lateral side of the heel portion, and a medial arm disposed at the medial side of the heel portion. The heel extender has a protuberance that establishes a rearmost extent of the article of footwear. The sole structure has a first hardness and the protuberance has a second hardness greater than the first hardness.

20 Claims, 8 Drawing Sheets

(56) References Cited

U.S. PATENT DOCUMENTS

| | | | | | |
|---|---|---|---|---|---|
| 4,484,397 | A * | 11/1984 | Curley, Jr. | A43B 23/17 | 36/132 |
| 4,574,498 | A * | 3/1986 | Norton | A43B 23/17 | 36/114 |
| 4,660,301 | A * | 4/1987 | Atwood | A43B 5/007 | 36/72 B |
| 4,854,055 | A * | 8/1989 | Sugiyama | A43B 5/00 | 36/127 |
| 4,947,560 | A * | 8/1990 | Fuerst | A43B 5/00 | 36/114 |
| RE35,708 | E * | 1/1998 | Malloy | A43B 5/08 | 36/114 |
| 6,826,851 | B2 * | 12/2004 | Nelson, Jr. | A43B 5/005 | 24/712 |
| 7,814,685 | B1 * | 10/2010 | Tankson | A43B 23/30 | 36/72 B |
| 8,061,059 | B2 * | 11/2011 | Bruce | A43B 13/143 | 36/114 |
| D722,425 | S * | 2/2015 | Cin | D2/947 | |
| 9,867,426 | B2 * | 1/2018 | Conant | A43B 13/148 | |
| 2004/0221485 | A1 * | 11/2004 | Pfander | A43B 1/0009 | 36/30 R |
| 2005/0138846 | A1 * | 6/2005 | O'Connor | A43B 5/007 | 36/72 B |
| 2008/0134545 | A1 * | 6/2008 | Suzuki | A43B 5/007 | 36/131 |
| 2009/0019729 | A1 * | 1/2009 | Nakano | A43B 7/14 | 36/91 |
| 2009/0064538 | A1 * | 3/2009 | Roether | A43B 13/026 | 36/88 |
| 2015/0342300 | A1 * | 12/2015 | Cin | A43B 17/003 | 36/103 |

* cited by examiner

ARTICLE OF FOOTWEAR WITH HEEL EXTENDER

CROSS-REFERENCE TO RELATED APPLICATION

This application claims the benefit of priority to U.S. application Ser. No. 15/063,968, filed Mar. 8, 2016, which is hereby incorporated by reference in its entirety.

TECHNICAL FIELD

The present teachings generally include an article of footwear.

BACKGROUND

Footwear typically includes a sole structure configured to be located under a wearer's foot to space the foot away from the ground or floor surface. Athletic footwear in particular sometimes utilizes polyurethane foam, rubber, or other resilient materials in the sole structure to provide cushioning.

DESCRIPTION

Figure 1:
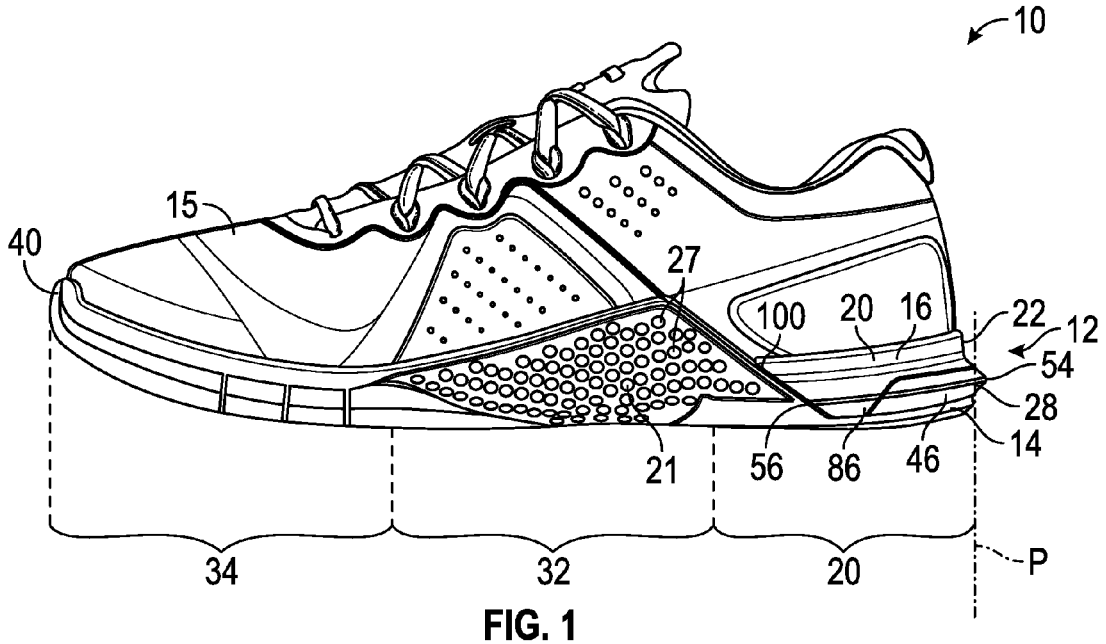
FIG. 1 is a schematic illustration in medial side view of an article of footwear including a sole structure with a heel extender in accordance with the present teachings.

Various embodiments of an article of footwear are provided that include a relatively hard, smooth heel extender protruding at a heel portion of the article of footwear. As discussed herein, the heel extender extends further and is harder than adjacent components of the article of footwear to contact and provide ease of movement of the heel portion across a surface during various activities. For example, the heel extender is configured to contact a vertical wall surface during inverted wall push-up exercises. Additionally, the heel extender acts as a retaining wall that limits deformation of the article of footwear, such as by limiting outward deformation of a midsole layer under heavy loading, such when worn during weightlifting. The article of footwear also includes a variety of other features making it suitable for use in different activities, including athletic activities, such as but not limited to running, rope climbing, and weightlifting.

More specifically, an article of footwear includes a sole structure that has a heel portion with a rear, a lateral side, and a medial side. The article of footwear includes a heel extender that has a rear segment disposed at the rear of the heel portion, a lateral arm disposed at the lateral side of the heel portion, and a medial arm disposed at the medial side of the heel portion. The heel extender has a protuberance that establishes a rearmost extent of the article of footwear. The sole structure has a first hardness and the protuberance has a second hardness greater than the first durometer hardness. Stated differently, the sole structure is relatively soft, and the protuberance is relatively hard. The hardness may be determined according to a variety of indentation hardness tests, including but not limited to a Shore D durometer test. The hardness is a material property of the sole structure and of the heel extender. Accordingly, the sole structure and the heel extender may be different materials, or could be the same material with different densities that provide the different hardness values.

The heel extender may have a variety of configurations, shapes, and positions on the article of footwear. For example, the protuberance may be any shape that establishes the rearmost extent and has the rear segment, lateral arm, and medial arm as described. The protuberance may have a beveled shape, which may include a single bevel (i.e., a single angled surface) or two bevels (i.e., bi-beveled with two angled surfaces, such as an upper bevel and a lower bevel). Alternatively, other non-limiting examples include a protuberance with a rounded shape, or a protuberance that includes a series of discrete protrusions establishing the rear segment, the medial arm, and the lateral arm.

In one embodiment, the lateral arm and the medial arm are contiguous with and extend from the rear segment. For example, the rear segment, the lateral arm, and the medial arm may be configured in a C-shape.

For example, in one embodiment, the sole structure includes a midsole layer exposed at the heel portion, and the heel extender includes a base disposed on an outer surface of the midsole layer, and a bevel that slopes from the protuberance to the base. Additionally, the outer surface of the midsole layer adjacent the bevel may slope in continuance from the bevel. The entire heel extender may be below an upper extent of the midsole layer.

In an embodiment, the heel extender has a base, and a beveled outer surface with at least one of an upper bevel that slopes from the protuberance to the base and a lower bevel that slopes from the protuberance to the base. In such an embodiment, the protuberance is between the upper bevel and the lower bevel.

The protuberance may include a continuous ridge that extends along each of the rear segment, the lateral arm, and the medial arm. For example, the continuous ridge may be between upper and lower bevels of the protuberance. The protuberance may be the furthest medial extent of the article of footwear at the medial arm, and the furthest lateral extent of the article of footwear at the lateral arm.

In various embodiments, the sole structure includes a midsole layer having features complementary to those of the heel extender. In an embodiment, the sole structure includes a midsole layer exposed at the heel portion. The heel extender is secured to the midsole layer. The midsole layer includes a first ridge at the lateral side extending along the midsole layer in alignment with the protuberance on the lateral arm. The midsole layer also includes a second ridge at the medial side extending along the midsole layer in alignment with the protuberance on the medial arm.

In an embodiment, the midsole layer has a convex outer surface, and the heel extender has a concave inner surface flush with and secured to the convex outer surface of the midsole layer. The inner surface of the heel extender may have a first concavity from the medial arm to the lateral arm and a second concavity from an upper extent of the rear segment to a lower extent of the rear segment.

In an embodiment, the midsole layer is exposed at the heel portion, and the sole structure further includes an outsole underlying the midsole layer. The rear segment of the heel extender is secured to the midsole layer, and the heel extender includes a flange that extends from the rear segment and is disposed between the midsole layer and the outsole.

Additionally, the midsole layer may have an outer surface with a recess, and the heel extender may be nested in the recess. For example, the concave inner surface and the flange of the heel extender may fit to the outer surface of the midsole layer in the recess.

The midsole layer may include a first ridge at the lateral side of the heel portion extending in alignment with the protuberance on the lateral arm, and a second ridge at the medial side of the heel portion extending in alignment with the protuberance on the medial arm.

In one embodiment, the heel extender ends at the medial and lateral arms. In another embodiment, the heel extender includes a medial wing portion and a lateral wing portion. The medial wing portion extends from the medial arm and is secured to a medial side of an upper operatively secured to the sole structure. The lateral wing portion extends from the lateral arm and is secured to a lateral side of the upper. The wing portions help to provide greater coverage of the heel extender at the medial and lateral sides of the heel portion, thus increasing the ability of the heel extender to act as a retaining wall and to provide the low drag feature of the heel extender over a broader range of positions of the article of footwear.

The heel extender may be a variety of different materials having different properties. For example, in one embodiment, the heel extender may have a hardness value from about 60 to about 70 on a Shore D durometer scale. The heel extender may be but is not limited to a material that is at least partially a thermoplastic polyurethane (TPU), a metal, such as aluminum, a nylon, a ceramic material, bamboo, or wood. Moreover, the protuberance can have a first average surface roughness, and the sole structure can have a second average surface roughness greater than the first average surface roughness. The smoothness (i.e., the lower surface roughness) of the protuberance may be achieved by polishing at least a portion of the protuberance. For example, the heel extender 28 may be a polished TPU, and the sole structure may be unpolished, less smooth materials such as polymeric foam and rubber materials In one embodiment, an article of footwear comprises an upper, and a sole structure supporting the upper. The upper and the sole structure establish a heel portion of the article of footwear. The article of footwear includes a C-shaped heel extender that has a rear segment disposed at a rear of the heel portion, a lateral arm disposed at a lateral side of the heel portion, and a medial arm disposed at a medial side of the heel portion. The heel extender has a continuous ridge sufficiently protruding at the rear segment, at the lateral arm, and at the medial arm to establish an outermost periphery of the article of footwear along the continuous ridge. The heel extender has a hardness greater than a hardness of the sole structure, such as but not limited to on a Shore D durometer scale. The heel extender may have a base, a first bevel extending from the continuous ridge to the base, and a second bevel extending from the continuous ridge and to the base, with the continuous ridge between the first bevel and the second bevel. The sole structure may include a midsole layer that is exposed at the heel portion, and may further include an outsole. The heel extender may be secured to an outer surface of the midsole layer, and the outer surface of the midsole layer may slope in parallel with the upper bevel. Furthermore, an outer surface of the outsole may follow a slope of the lower bevel. For example, the outsole may have a bevel at the rear of the heel portion, and the bevel may be at the same angle as the lower bevel.

Referring to the drawings, wherein like reference numbers refer to like components throughout the several views, FIG. 1 is a medial side view of an article of footwear 10 that includes a sole structure 12. The sole structure 12 has an outsole 14, an outer midsole layer 16, also referred to as an external midsole, and an inner midsole layer 18 (shown in FIG. 3), also referred to as a drop-in midsole. An upper 15 is secured directly or indirectly to the sole structure 12 generally above the sole structure 12. The sole structure 12 has a heel portion 20 with a rear 22, a lateral side 24, and a medial side 26. The sole structure 12 has a heel extender 28 secured to the heel portion 20 of the sole structure 12. More specifically, the heel extender 28 is secured to an outer surface 30 of the outer midsole layer 16 such that the heel extender 28 is exposed on the heel portion 20.

As best shown in FIG. 1, the sole structure 12 has a heel portion 20, a midfoot portion 32, and a forefoot portion 34. The midfoot portion 32 is between the heel portion 20 and the forefoot portion 34. The heel portion 20 generally includes portions of the sole structure 12 corresponding with rear portions of a human foot including the calcaneus bone and of a size corresponding with the article of footwear 10. Forefoot portion 34 generally includes portions of the sole structure 12 corresponding with the toes and the joints connecting the metatarsals with the phalanges of the human foot of the size corresponding with the article of footwear 10. Midfoot portion 32 generally includes portions of the sole structure 12 corresponding with an arch area of the human foot of the size corresponding with the article of footwear 10. The portions 20, 32, 34 are intended to represent general areas of the sole structure 12 relative to one another to provide a frame of reference during the following discussion, and also apply to and are used to describe portions of the article of footwear 10 or of any component of the article of footwear 10.

As used herein, a lateral side of the article of footwear 10 or of a component of the article of footwear 10, such as a lateral side 24 of the sole structure 12, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for an article of footwear, such as a medial side 26 of the article of footwear 10, is the side that corresponds with an inside area of the foot of the wearer and is generally closer to the other foot of the wearer (i.e., the side closer to the hallux of the foot of the wearer). The hallux is commonly referred to as the big toe. A rear 38 of the heel portion 20 extends between the lateral side 24 and the medial side 26, and a front 40 of the forefoot portion 34 extends between the lateral side 24 and the medial side 26.

Figure 2:
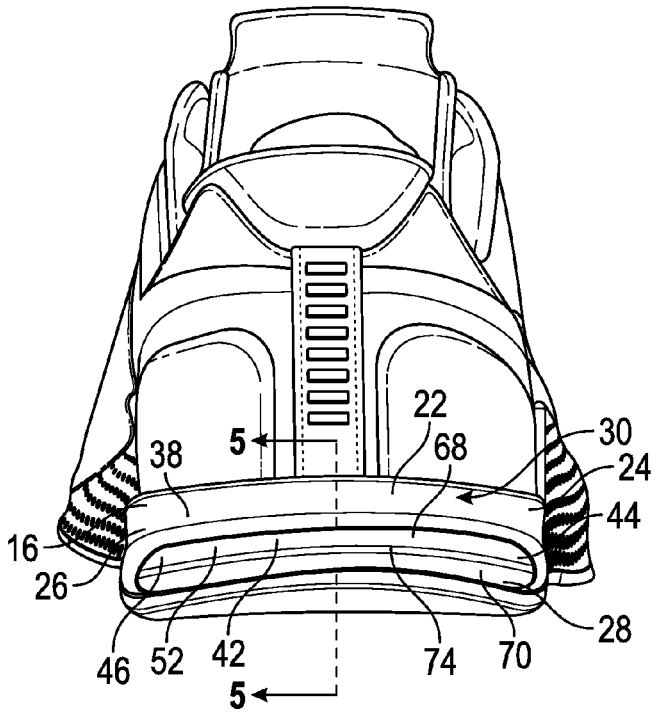
FIG. 2 is a schematic illustration in rear view of the article of footwear of FIG. 1.
Figure 7:
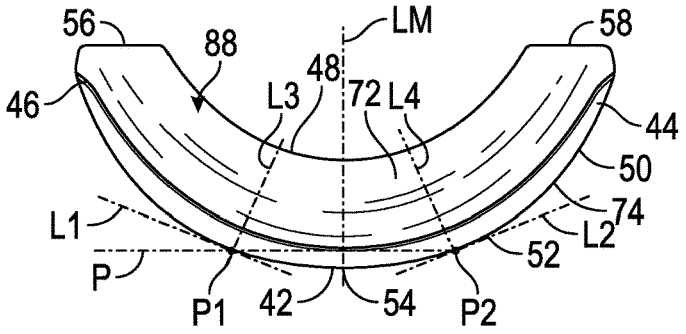
FIG. 7 is a schematic illustration in plan view of a heel extender of FIG. 1.

As best shown in FIGS. 2 and 7, the heel extender 28 includes a rear segment 42 disposed at the rear 22 of the heel portion 20, a lateral arm 44 disposed at the lateral side 24 of the heel portion 20, and a medial arm 46 disposed at the medial side 26 of the heel portion 20. The heel extender 28 is a unitary, one-piece component. The medial arm 46 and the lateral arm 44 extend contiguously from the rear segment 42. The heel extender 28 includes a protuberance 52 that establishes a rearmost extent 54 of the article of footwear 10. In the embodiment shown, the protuberance 52 is also the furthest medial extent of the heel portion 20 at the medial arm 46, and the furthest lateral extent of the heel portion 20 at the lateral arm 44. This is best illustrated in the bottom view of FIG. 8 in which the perimeter of the outsole 14 is indicated in phantom.

Figure 4:
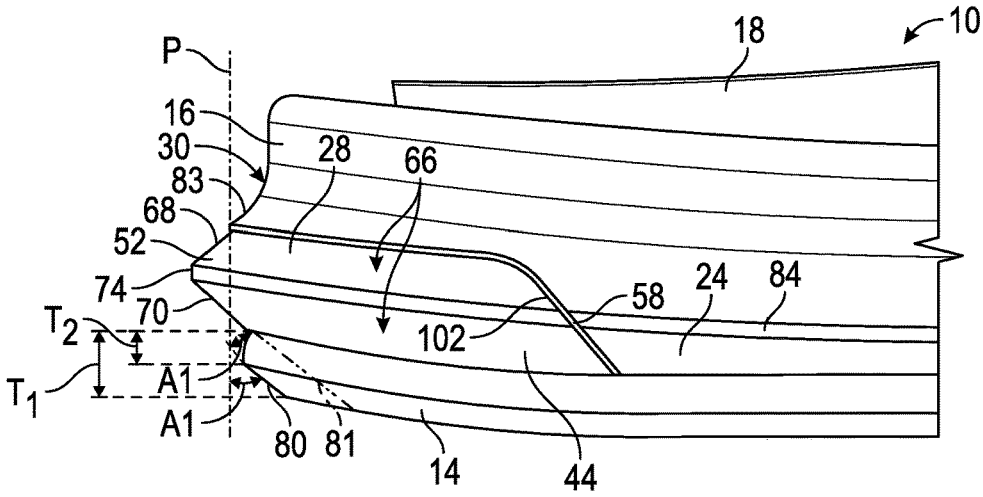
FIG. 4 is a schematic illustration in fragmentary lateral side view of the sole structure of FIG. 3.

For purposes of illustration, a vertical plane P perpendicular to a longitudinal midline LM of the heel extender 28 and drawn at the exposed portion of the heel extender 28 can be used to denote the rear segment 42, the lateral arm 44, and the medial arm 46. The plane P is indicated in FIGS. 4 and 7 and intersects the outer edge of the protuberance 52 at a point P1. A line L1 is drawn tangent to the protuberance 52 at the point P1. The plane P also intersects the outer edge of the protuberance 52 at a point P2. A line L2 is drawn tangent to the protuberance at the point P2. The rear segment 42 can be defined as that portion of the heel extender 28 between a line L3 perpendicular to the line L1 at point P1 and a line L4 perpendicular to the line L2 at point P2. The lateral arm 44 can be defined as that portion of the heel extender 28 between the line L3 and a first end 56 of the heel extender 28. The medial arm 46 can be defined as that portion of the heel extender 28 between the line L4 and a second end 58 of the heel extender 28. Generally, in the medial side view of FIG. 1, the medial arm 26 is the entire portion to the left of the plane P in FIG. 1. The lateral arm 44 is the entire portion of the heel extender 28 to the right of plane P in the lateral side view of FIG. 4. The heel extender 28 is generally C-shaped in plan view as indicated in FIG. 7, with a concave inner boundary 48 and a convex outer boundary 50 in plan view.

Figure 8:
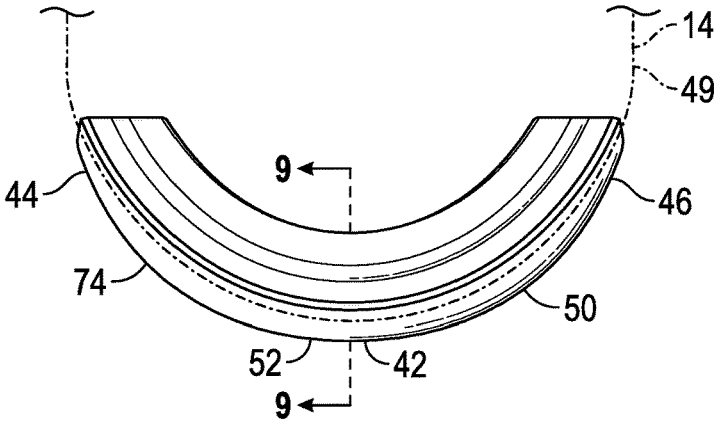
FIG. 8 is a schematic illustration in bottom view of the heel extender of FIG. 1.

The outer periphery 49 of the outsole 14 is shown in phantom in FIG. 8. The protuberance 52 protrudes further than the outsole 14 in that it is the furthest medial extent along the entire medial arm 46, is the furthest lateral extent of the sole structure 12 along the entire lateral arm 44, and is the furthest rear extent (i.e. rearmost extent) along the entire rear segment 42 as shown in FIG. 8. Additionally, the protuberance 52 is also the furthest medial, lateral, and rear extent of the entire article of footwear 10, including the upper 15, along the entire medial arm 46, lateral arm 44, and rear segment 42, respectively.

Figure 6:
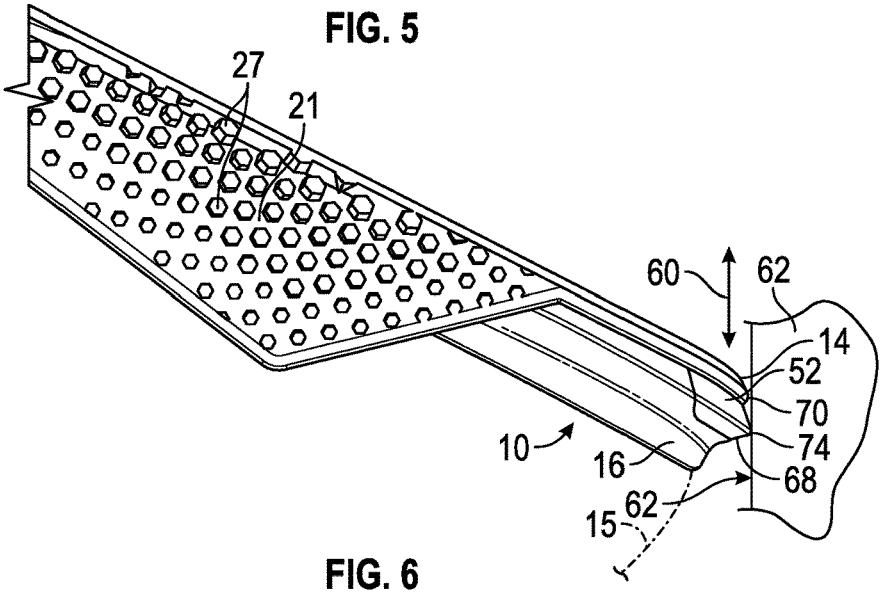
FIG. 6 is a schematic illustration in fragmentary inverted view of the sole structure of FIG. 3 with the heel extender positioned for movement against a vertical surface.

By establishing the rearmost extent, the furthest medial extent, and the furthest lateral extent of the article of footwear 10, the protuberance 52 is configured to make contact with an adjacent surface, such as a relatively flat, planar surface, in lieu of the sole structure 12 or the upper 15 over a wide range of positions and angles of the article of footwear 10 relative to the adjacent surface. For example, as shown in FIG. 6, when the article of footwear 10 is inverted and moved vertically up and/or down (as indicated by the double-sided arrow 60), with the heel extender 28 resting against a wall 62, such as when worn during an inverted wall pushup only the heel extender 28 will be in contact with the wall 62. The heel extender 28 rather than the sole structure 12 or the upper 15 will contact the wall 62. In the embodiment of FIG. 6, the range of angles is at least 90 degrees.

Similarly, the heel extender 28 can be positioned against another surface such as a floor for movements requiring sliding motion of the heel portion 20 along the floor or other surface without the sole structure 12 and upper 15 in contact with the floor. The heel extender 28 will be the only component of the article of footwear 10 against the floor or other surface.

The heel extender 28, or at least the protuberance 52 of the heel extender 28 is harder than the components of the sole structure 12. More specifically, the components of the sole structure 12 have no more than a first hardness and the protuberance 52 has a second hardness greater than the first hardness. The hardness is an indentation hardness and the value of the hardness may be measured on a Shore D durometer scale or by another hardness test or scale well known to those skilled in the art. For example, the second hardness may be a hardness value at least 44 points harder than the first hardness on a Shore D durometer scale. In the embodiment shown, the inner midsole layer 18 and the outer midsole layer 16 may be an ethylene vinyl acetate (EVA) foam. Alternatively, one or both of the midsole layers 16, 18 could be replaced by or used in conjunction with a sole layer that is a fluid-filled bladder element, that may be a polymeric, fluid-retaining material. For example, the bladder element may have thermoplastic polyurethane layers that alternate with one or more second layers, also referred to herein as barrier layers, gas barrier polymers, or gas barrier layers, that comprise a copolymer of ethylene and vinyl alcohol (EVOH) that is impermeable to the pressurized fluid contained therein as disclosed in U.S. Pat. No. 6,082,025 to Bonk et al., which is incorporated by reference in its entirety. The outsole 14 may be a thermoplastic rubber or other durable material. The material for the outsole 14 may be selected to provide a desirable combination of durability and flexibility. The heel extender 28, including the protuberance 52, may be at least partially a thermoplastic polyurethane, metal, nylon, bamboo, wood, or ceramic material. Additionally, the protuberance 52 may be polished, formed, or otherwise provided with a first average surface roughness, while the sole structure 12 has a second average surface roughness greater than the first average surface roughness. In other words, the protuberance 52 is smoother than the sole structure 12.

The shape and hardness of the protuberance 52 helps to reduce the contact area of the heel extender 28 with the wall 62. For example, the heel extender 28 is sufficiently hard that it will not significantly deform under an expected range of loads while the protuberance 52 is in contact with the wall 62 or other surface. The smoothness together with the hardness helps to provide a relatively low coefficient of friction of the heel extender 28 when the heel extender 28 is moved across a surface, such as the wall 62. The heel extender 28 is harder and has a lower coefficient of friction than both the sole structure 12 and the upper 15. Accordingly, by configuring the article of footwear 10 so that it can be positioned with the heel extender 28 as the only portion of the article of footwear 10 in contact with the surface upon which the article of footwear 10 is moving, the force required to move the article of footwear 10 across the wall 62 is lower than if the sole structure 12 (including the outsole 14 and the midsole layer 16) or the upper 15 are in contact with the wall 62.

In one embodiment, the heel extender 28 is a thermoplastic polyurethane with a highly polished surface and a hardness of 66 on a Shore D durometer scale. In other embodiments, the hardness of the protuberance 52 may be from 60 to 70 on a Shore D durometer scale.

The hardness of the heel extender 28 relative to the midsole layer 16 also provides desired stiffness and rigidity of the heel portion 20 of the article of footwear 10 when loading creates forces in the rear, lateral, and medial directions. The heel extender 28 acts as a retaining wall that limits outward deformation of the midsole layer 16 under heavy loading, such as when worn during weightlifting. Because the heel extender 28 has a rear segment 42, a lateral arm 44, and a medial arm 46 as described, the heel extender 28 surrounds the heel portion 20 from the rear 22, the lateral side 24, and the medial side 26, and is able to limit outward deformation of the midsole layer 16 in rearward, lateral, and medial directions.

A heel extender within the scope of the present teachings can have various shapes and configurations that provide a protuberance as described. For example, in the embodiment of FIGS. 1-10, the rear segment 42, the lateral arm 44, and the medial arm 46 are configured in a C-shape, having a concave inner boundary 48 and the convex outer boundary 50 with the lateral arm 44 and the medial arm 46 contiguous with and extending from the rear segment 42.

Figure 5:
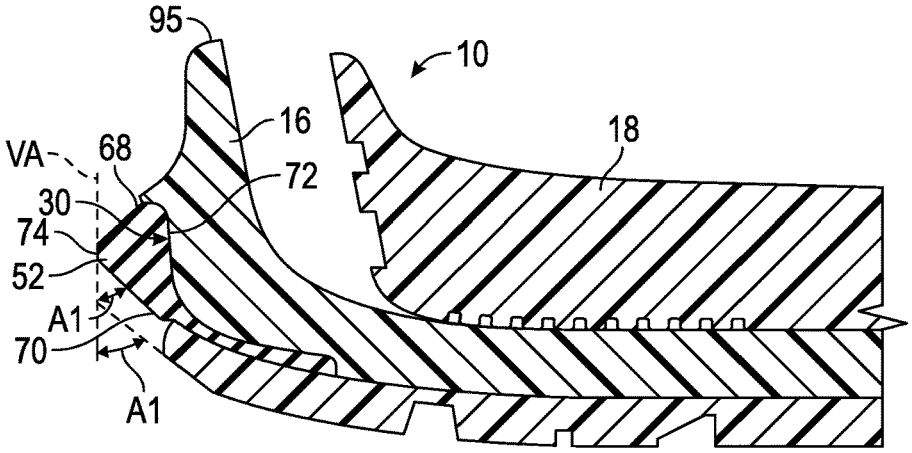
FIG. 5 is a schematic cross-sectional illustration of the sole structure of FIG. 5 taken at lines 5-5 in FIG. 2 with the upper not shown.

In the embodiment of FIGS. 1-10, the heel extender 28 has a beveled outer surface 66 that forms the protuberance 52. As best shown in FIGS. 4 and 5, the beveled surface 66 includes a first bevel 68, arranged as and referred to as an upper bevel 68, and a second bevel 70, arranged as and referred to as a lower bevel 70. The heel extender 28 has a base 72, which is a portion of the heel extender 28 closest to and disposed on and secured to the sole structure 12, and more specifically on the outer surface 30 of the midsole layer 16. The protuberance 52 is spaced from the base 72. More specifically, the protuberance 52 has a continuous ridge 74 at an apex of the protuberance 52 displaced from the base 72. The apex is the portion of the protuberance 52 furthest displaced from base 72, not necessarily the highest portion of the protuberance 52.

The continuous ridge 74 extends along each of the rear segment 42, the lateral arm 44, and the medial arm 46. The continuous ridge 74 is between the upper bevel 68 and the lower bevel 70. When the outsole 14 is on a ground surface, the protuberance 52 and continuous ridge 74 are generally horizontally disposed with the lateral arm 44 and medial arm 46 generally at the same elevation from the outsole 14. The continuous ridge 74 sufficiently protrudes at the rear segment 42, at the lateral arm 44, and at the medial arm 46 to establish an outermost periphery of the article of footwear 10 along the continuous ridge 74. The outer boundary 50 is at the continuous ridge 74 and is the outermost periphery of the heel extender 28 as shown in FIG. 8.

The upper bevel 68 slopes from the protuberance 52 to the base 72, and more specifically generally upward and forward from the ridge 74 of the protuberance 52 to the base 72 when the outsole 14 is in the position of FIGS. 1, 4, and 5 (e.g., on a ground surface). The second bevel 70 also slopes from the protuberance 52 to the base 72, but generally rearward and forward from the ridge 74 of the protuberance 52 to the base 72 when the outsole 14 is in the position of FIGS. 1, 4, and 5.

The beveled outer surface 66 of the protuberance 52 in the embodiment shown is bi-beveled (i.e., has two bevels 68, 70). In other embodiments, only one of the bevels may be provided. For example, if only the lower bevel 70 is provided, the rearward most extent 54 would still protrude further than the outsole 14 and the midsole layer 16, and would still be the only component of the article of footwear 10 in contact with the wall 62 in FIG. 6. The heel extender 28 could have any other shape at the portion that is provided in lieu of the upper bevel 68 in such an embodiment. If only the upper bevel 68 is provided, the rearward most extent 54 would still protrude further than the outsole 14 and the midsole layer 16, and the heel extender 28 would still be the only component of the article of footwear 10 in contact with the wall 62 in FIG. 6. The heel extender 28 could have any other shape at the portion that is provided in lieu of the lower bevel 70 in such an embodiment. In still other embodiments, a protuberance within the scope of the present teachings could have another shape without bevels, and instead could be a rounded ridge, a squared ridge, or a series of discrete protrusions arranged generally in the C-shape of the protuberance.

The outsole 14 may also have a bevel that ensures that the heel extender 28 alone contacts the wall 62 or other surface over a wide range of positions of the heel extender 28 relative to the wall 62. As is apparent in FIGS. 4-6, the outsole 14 has a bevel 80 at the rear 22 of the heel portion 20. In the embodiment shown, the bevel 80 extends to the medial and lateral sides 26, 24 of the outsole 14 as well. Optionally, as shown, the bevel 80 and the lower bevel 70 of the heel extender 28 extend at a common angle A1 relative to a vertical axis, such as the vertical axis at the intersection of plane P and the longitudinal midline LM shown in FIG. 7 (which can be represented by plane P in FIG. 4) or the vertical axis VA in FIG. 5.

Optionally, the outsole 14 could instead be configured with a bevel that extends in direct alignment and continuance with the bevel 70, as indicated by phantom line 81 in FIG. 4, representing an alternative bevel. In other words, the bevel at phantom line 81 would follow the slope of the lower bevel 70. The bevel 80 (or 81) reduces the thickness of the outsole 14 at the rear extremity of the outsole 14, such as from thickness T1 to thickness T2 in FIG. 4. This allows the article of footwear 10 to be tilted upward at a higher angle relative to the wall 62 in FIG. 6 without the outsole 14 contacting the wall 62 than would be possible if the outsole 14 had the full thickness T1 at the extreme rear of the outsole 14. Because the bevel 80 (or 81) extends on the medial side 26 and the lateral side 24 of the heel portion 20 as well, the range of angles and positions of the article of footwear 10 relative to the wall 62 or other surface over which the outsole 14 will not interfere with the heel extender 28 being the only portion of the article of footwear 10 in contact with the surface is increased when the medial arm 46 or lateral arm 44 of the heel extender 28 is adjacent the wall 62 rather than the rear segment 42.

The midsole layer 16 is also configured to ensure that the heel extender 28 alone contacts the wall 62 or other surface over a wide range of positions of the article of footwear 10 relative to the wall 62. The outer surface 30 of the midsole layer 16 adjacent the upper bevel 68 is parallel with the upper bevel 68, as best indicated by the side view of FIG. 4 in which the portion 83 of the outer surface 30 is parallel with the upper bevel 68. The outer surface 30 can be said to slope in parallel with the upper bevel 68 at the portion 83.

The midsole layer 16 is also configured to minimize contact area with a surface such as the wall 62 should contact of the midsole layer 16 with the wall 62 occur forward of the heel extender 28. As shown in FIG. 4, the midsole layer 16 has a first ridge 84 at the lateral side 24 extending along the midsole layer 16 and in alignment with the ridge 74 of the protuberance 52 on the lateral arm 44. The midsole layer 16 also has a second ridge 86 at the medial side 26 extending along the midsole layer 16 in alignment with the ridge 74 of the protuberance 52 on the medial arm 46. The ridges 84, 86 have upper and lower bevels generally disposed at the same angle relative to a vertical axis as the upper and lower bevels 68, 70, respectively. Due to the ridges 84, 86, the midsole layer 16 forward of the lateral arm 44 and the midsole layer 16 forward of the medial arm 46 continues the slope of the bevels 68, 70 and thereby slopes in continuance from the bevels, 68, 70.

Figure 9:
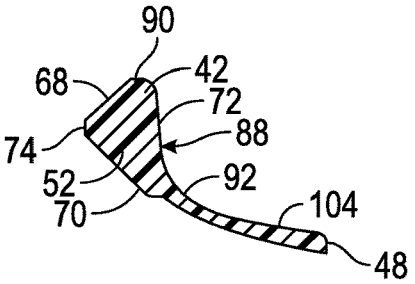
FIG. 9 is a schematic cross-sectional illustration of the heel extender of FIG. 8 taken at lines 9-9 in FIG. 8.
Figure 10:
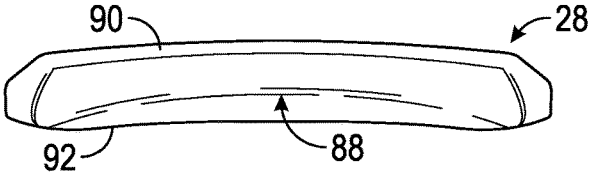
FIG. 10 is a schematic illustration in front view of the heel extender of FIG. 1.

The midsole layer 16 and the heel extender 28 are cooperatively configured to fit to one another. As shown in FIG. 7, the heel extender 28 has an inner surface 88 at the base 72 with a first concavity from the medial arm 46 to the lateral arm 44 as indicated by the C-shape of the heel extender 28 and the concave inner boundary 48. The inner surface 88 of the heel extender 28 also has a second concavity from an upper extent 90 of the rear segment 42 to a lower extent 92 of the rear segment 42, as shown in FIG. 9. The second concavity continues to the flange 104 of the heel extender 28 discussed herein.

Figure 3:
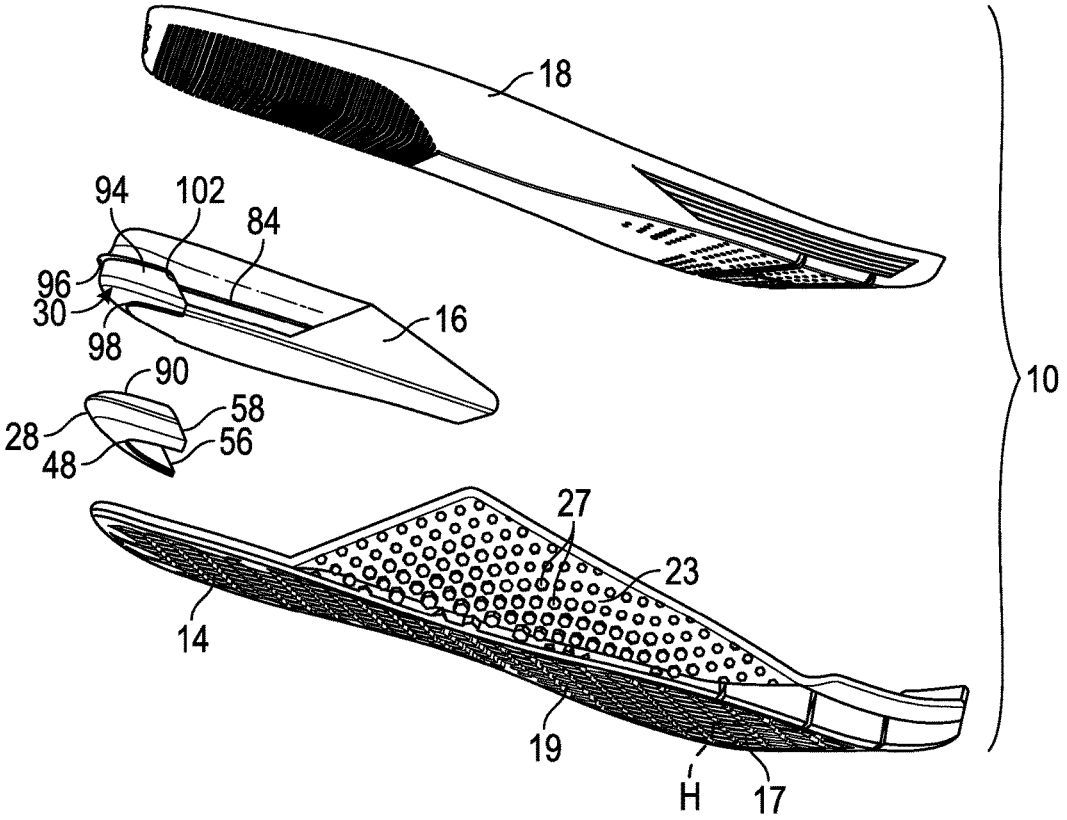
FIG. 3 is a schematic exploded perspective view of a sole structure of the article of footwear of FIG. 1.

As shown in FIG. 3, the midsole layer 16 has a convex outer surface 30. The concavity of the inner surface 88 of the heel extender 28 is configured to be flush with the convex outer surface 30 of the midsole layer 16. In other words, the entire inner surface 88 is in contact with the concave outer surface 30 of the midsole layer 16. The concave inner surface 88 can be secured to the convex outer surface 30 with adhesive or may be thermally bonded to the midsole layer 16. In an embodiment in which the midsole layer 16 is a fluid-filled bladder element, the heel extender 28 may be thermally bonded to the fluid-filled bladder element.

Additionally, with reference to FIG. 3, the midsole layer 16 has a recess 94 at the outer surface 30. The recess 94 is sized to match the shape of the outer extent of the heel extender 28. This enables the heel extender 28 to be nested in the recess 94. The upper extent 90 of the heel extender 28 fits in the recess 94 adjacent an upper extent 96 or upper edge of the recess 94. The inner boundary 48 of the heel extender 28 fits in the recess 94 adjacent a lower extent 98 or lower edge of the recess 94. As indicated in FIG. 1, the first end 56 of the heel extender 28 fits adjacent a medial extent 100 or medial edge of the recess 94. As is apparent in FIGS. 3 and 4, the second end 58 of the heel extender 28 fits adjacent a lateral extent 102 or lateral edge of the recess 94. When secured to the midsole layer 16, the entire heel extender 28 is below the upper extent 95 of the midsole layer 16.

As best shown in FIG. 9, the heel extender 28 includes a flange 104 that extends forward from the rear segment 42 and establishes the inner boundary 48. When the heel extender 28 is secured to the outer surface 30 of the midsole layer 16, the flange 104 is disposed between the midsole layer 16 and the outsole 14. Stated differently, the flange 104 is sandwiched between the midsole layer 16 and the outsole 14 and is not visible in the assembled article of footwear 10 of FIG. 1. The flange 104 may be adhered and/or thermally bonded to the midsole layer 16 and the outsole 14. Trapping the flange 104 between the outsole 14 and the midsole layer 16 in this manner helps to anchor and secure the heel extender 28 to the sole structure 12.

The inner midsole layer 18 is not adhered or otherwise secured to any component of the article of footwear 10, thereby preventing undesirable rigidity. The inner midsole layer 18 is not as hard as the outer midsole layer 16 to enhance cushioning for running or other activities, while at the same time the outer midsole layer 16 and the outsole 14 provide stability for activities such as weightlifting. Moreover, the outsole 14 includes medial and lateral arch portions 21, 23 shown in FIGS. 1 and 3 that extend upward along and are secured to the medial side 26 of the upper 15 and to a lateral side 24 of the upper 15 to provide traction for activities such as rope climbing.

FIG. 3 shows that the outer midsole layer 16 extends only over the heel portion 20 and over some of the midfoot portion 32. The inner midsole layer 18 is supported by the outer midsole layer 16 and the outsole 14 but is not fixed thereto. In other words, the inner midsole layer 18 is not adhered, sewn, bonded, welded, or otherwise secured to any other component of the article of footwear 10. Instead, the inner midsole layer 18 simply rests on a strobel unit (not shown) within a cavity defined and bounded by the upper 15 and the strobel unit. The strobel unit is stitched to the upper 15 and is well understood by those skilled in the art. Alternatively, heat seaming, bonding, or other methods of securing the upper 15 to the strobel unit can be used. The strobel unit is also adhered or bonded directly to an upward-facing surface of the outer midsole layer 16 at the heel portion 20, to a portion of the midfoot portion 32 not covered by the outer midsole layer 16, and directly to an upward-facing surface of the outsole 14 at the forefoot portion 34. The upper 15 can be comprised of multiple separate pieces and materials such as fabric, textiles, leather, plastics, etc.

As shown in FIG. 9, the inner midsole layer 18 is a full-length midsole layer, such that it extends over the heel portion 20, the midfoot portion 32, and the forefoot portion 34 when placed in the foot-receiving cavity within the upper 15. The inner midsole layer 18 can thus be selectively inserted or removed from the cavity, and is referred to as a drop-in midsole. Because the inner midsole layer 18 is not secured to any component of the article of footwear 10, it may exhibit some minimal relative movement with respect to the sole structure 12 under some load forces. This reduces rigidity, and produces a flexible feel during wear. However, the inner midsole layer 18 is supported by outer midsole layer 16 and the outsole 14, and is relatively confined by the outer midsole layer 16 and the upper 15. For example, as best shown in FIGS. 4 and 5, the outer midsole layer 16 is configured to surround a periphery of the inner midsole layer 18 at the heel portion 20. As also discussed herein, the heel extender 28 provides additional peripheral support to the outer midsole layer 16 in the heel portion 20.

The outer midsole layer 16 may be harder than the inner midsole layer 18. For example, in one embodiment, the outer midsole layer 16 is seven points harder than the inner midsole layer 18 when hardness is measured on a Shore D durometer scale. Both the inner midsole layer 18 and the outer midsole layer 16 can be a polymeric foam, such as ethylene vinyl acetate (EVA) foam. The inner midsole layer 18 can be a lighter weight, less dense foam than the outer midsole layer 16. The inner midsole layer 18 is configured with a substantially uniform hardness that provides appropriate cushioning and compliance under the heel of a wearer, while the surrounding outer midsole layer 16 is harder to provide lateral support, resiliency, and energy absorption at the heel region 36.

Moreover, the outsole 14 includes medial and lateral arch portions 21, 23 shown in FIGS. 1, 2, 3, and 6. The medial arch portion 21 extends upward along and is secured to the medial side 26 of the footwear upper 15. The lateral arch portion 23 extends upward along and is secured to the lateral side 24 of the upper 15. The medial and lateral arch portions 21, 23 have a plurality of spaced protrusions 27 configured to provide traction for activities such as rope climbing. The protrusions 27 generally protrude further closer to the bottom portion of the outsole 14, and are wider closer to the bottom portion.

The outsole 14 has a bottom portion that establishes a ground contact surface. The outsole 14 is not of a uniform hardness. The bottom portion may have a first portion with a first hardness and a second portion with a second hardness greater than the first hardness. The first portion extends over only some of the forefoot portion 34 and the second portion surrounds the first portion and extends over a remainder of the outsole 14. The softer first portion increases traction in the forefoot portion.

Specifically, FIG. 3 shows a boundary H that generally separates a first portion 17 of the outsole 14 from a second portion 19 of the outsole 14. The first portion 17 extends over only some of the forefoot portion 34 and coincides generally with a pressure-bearing region under the ball of a wearer's foot. The second portion 19 includes the entire remainder of the outsole 14. The first portion 17 has a hardness less than a hardness of the second portion 19 on a Shore D durometer scale. The softer first portion 17 has a greater coefficient of friction with respect to a ground surface than does the harder rubber of the second portion 19. The first portion 17 is thus both more compliant and provides greater traction with respect to forces conveyed from the ball of a wearer's foot through the forefoot portion 34, such as during lateral movement and/or climbing.

FIGS. 11-16 show another embodiment of an article of footwear 210 having many of the features of the article of footwear 10. Identical reference numbers are used for components and features that are the same as those of the article of footwear 10. The article of footwear 210 has a sole structure 212 that has a heel portion 20 with a rear (at a rear segment 242), a lateral side 24, and a medial side 26. The sole structure 212 includes an outsole 214 and a drop-in inner midsole layer 18. The sole structure 212 has no outer midsole layer, and therefore no outer midsole layer is exposed at the heel portion 20 as in the sole structure 12. Instead, the outsole 214 is the only portion of the sole structure 212 exposed at the heel portion 20.

The article of footwear 210 includes a heel extender 228 that has a rear segment 242 disposed at the rear of the heel portion 20, a lateral arm 244 disposed at the lateral side 24 of the heel portion 20, and a medial arm 246 disposed at the medial side 26 of the heel portion 20. The lateral arm 244 and the medial arm 246 are contiguous with and extend from the rear segment 242. The rear segment 242, the lateral arm 244, and the medial arm 246 are configured generally in a C-shape as is most apparent in FIG. 14.

Figure 13:
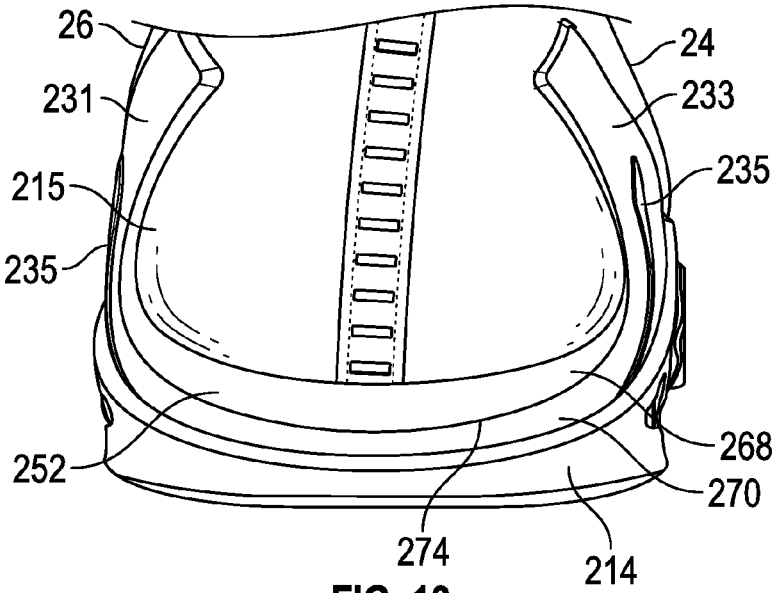
FIG. 13 is a schematic illustration in rear view of the article of footwear of FIG. 11.
Figure 14:
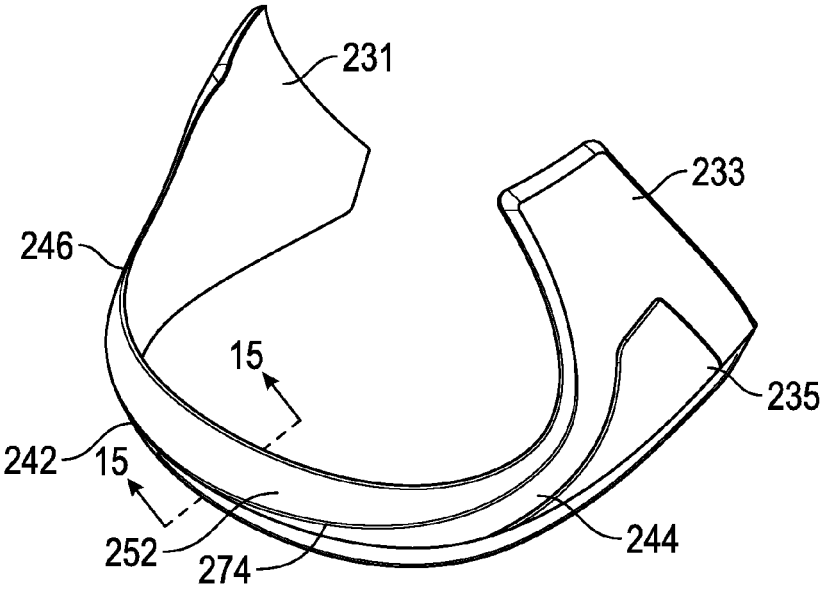
FIG. 14 is a schematic perspective illustration of the heel extender of the article of footwear of FIG. 11.

The heel extender 228 does not terminate at the medial arm 246 and the lateral arm 244 as does the heel extender 28. Instead, the heel extender 228 includes a medial wing portion 231 and a lateral wing portion 233. The medial wing portion 231 extends from the medial arm 246 and is secured to a medial side 26 of the upper 215 as best shown in FIG. 13. A lateral wing portion 233 extends from the lateral arm 244 and is secured to a lateral side 24 of the upper 215. The wing portions 231, 233 provide lateral and medial support at the heel portion 20 in addition to the support and stability provided by the rear segment 242, the medial arm 246 and the lateral arm 244, such as during weightlifting. The wing portions 231, 233 have regions 235 that are more highly polished than the remainder of the heel extender 228. The regions 235, the wing portions 231, 233, the rear segment 242, the medial arm 246, the lateral arm 244, the protuberance 252, and the flange 204 discussed herein are all integrally formed as part of the unitary, one-piece heel extender 228.

Figure 15:
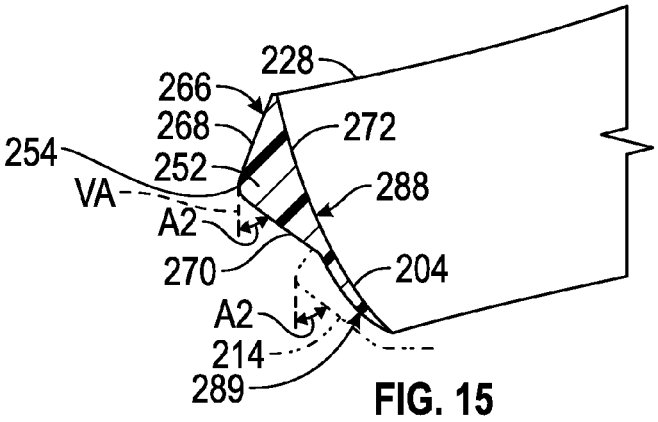
FIG. 15 is a schematic cross-sectional and fragmentary illustration of the heel extender of FIG. 14 taken at lines 15-15 in FIG. 14.
Figure 16:
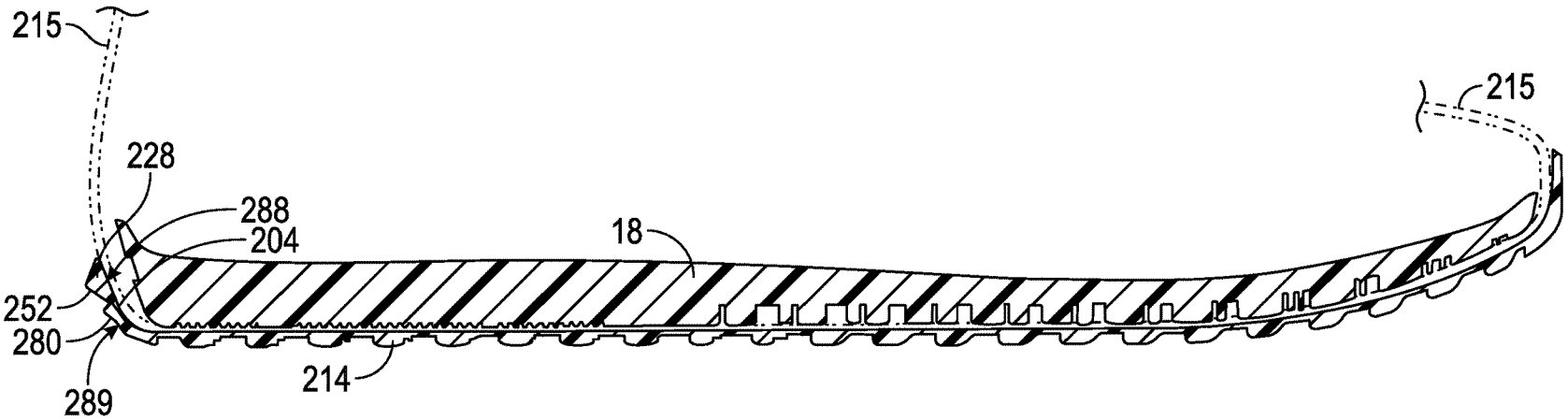
FIG. 16 is a schematic cross-sectional illustration of the article of footwear of FIG. 12 taken at lines 16-16 in FIG. 12.

The heel extender 228 is secured to both the upper 215 and the outsole 214, at the rear 22 as best shown in FIG. 16. More specifically, an inner surface 288 of the heel extender 228 is secured to the upper 215. The heel extender 228 includes a flange 204 best shown in FIG. 15. An outer surface 289 of the heel extender 228 at the flange 204 is secured to the outsole 214 such as with adhesive or by thermal bonding. The flange 204 is thus sandwiched between the outsole 214 and the upper 215 and is not exposed.

The heel extender 228 includes a protuberance 252 that establishes a rearmost extent 254 of the article of footwear 210. In the embodiment shown, the protuberance 252 is also the furthest medial extent of the heel portion 20 at the medial arm 246, and the furthest lateral extent of the heel portion 20 at the lateral arm 244. By establishing the rearmost extent, the furthest medial extent, and the furthest lateral extent, the protuberance 252 is configured to make contact with an adjacent surface, such as a relatively flat, planar surface, in lieu of the sole structure 212 or the upper 215, depending on the position and angle of the article of footwear 210 relative to the adjacent surface, as described with respect to the heel extender 28 of FIG. 6.

The heel extender 228 rather than the sole structure 212 or the upper 215 will contact the wall 62 of FIG. 6. The heel extender 228, or at least the protuberance 252 of the heel extender 228 is harder than the outsole 214. More specifically, the outsole 214 has no more than a first hardness and the protuberance 252 has a second hardness greater than the first hardness. The hardness values may be measured on a Shore D durometer scale or on another scale. For example, the second hardness may be at least 44 points harder than the first hardness on a Shore D durometer scale. The second hardness may be from about 60 to about 70 on a Shore D durometer scale. The outsole 214 may be a thermoplastic rubber or other durable material. The material for the outsole 214 may be selected to provide a desirable combination of durability and flexibility. The heel extender 228, including the protuberance 252, may be may be at least partially a thermoplastic polyurethane, metal, nylon, bamboo, wood, or ceramic material. Additionally, the protuberance 252 may be polished, formed, or otherwise provided with a first average surface roughness, while the outsole 214 has a second average surface roughness greater than the first average surface roughness. In other words, the protuberance 252 is smoother than the outsole 214. The protuberance 252 is also smoother than and harder than the upper 215. The hardness and smoothness of the protuberance 252 and of the entire heel extender 228 provide a reduced friction and low drag across surfaces such as the wall 62 or a floor in comparison to the sole structure 212 and the upper 215.

As shown in FIG. 15, the heel extender 228 has a base 272, and a beveled outer surface 266 with a first bevel, referred to as an upper bevel 268, and a second bevel, referred to as a lower bevel 270. The beveled outer surface 266 forms the protuberance 252. The base 272 is a portion of the heel extender 228 closest to and disposed on and secured to the outer surface of the upper 215. The protuberance 252 is spaced from the base 272. The protuberance 252 includes a continuous ridge 274 that extends along each of the rear segment 242, the lateral arm 244, and the medial arm 246. The continuous ridge 274 is between the upper bevel 268 and the lower bevel 270. The continuous ridge 274 sufficiently protrudes at the rear segment 242, at the lateral arm 244, and at the medial arm 246 to establish an outermost periphery of the article of footwear 210 along the continuous ridge 274. The rearmost extent 254 of the article of footwear 210 is at the continuous ridge 274.

Figure 11:
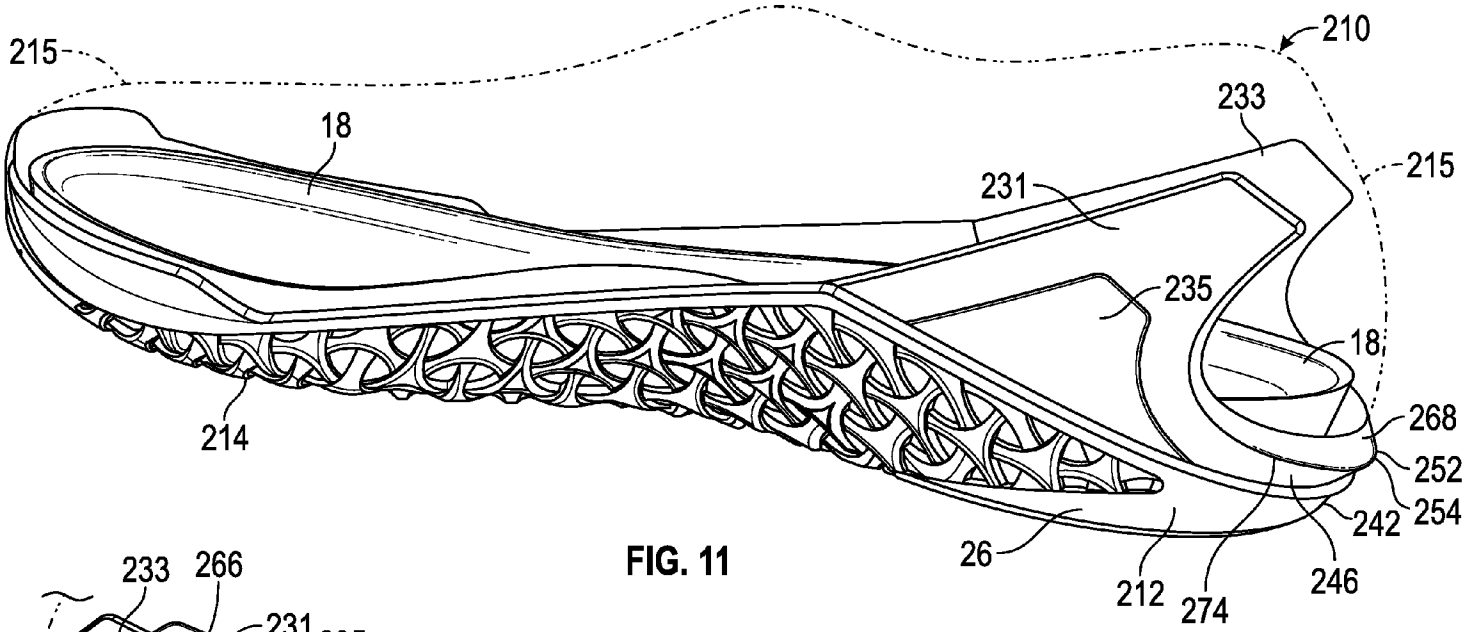
FIG. 11 is a schematic illustration in medial side view of an article of footwear including a sole structure with a heel extender in accordance with an alternative aspect of the present teachings and with an upper shown in phantom.
Figure 12:
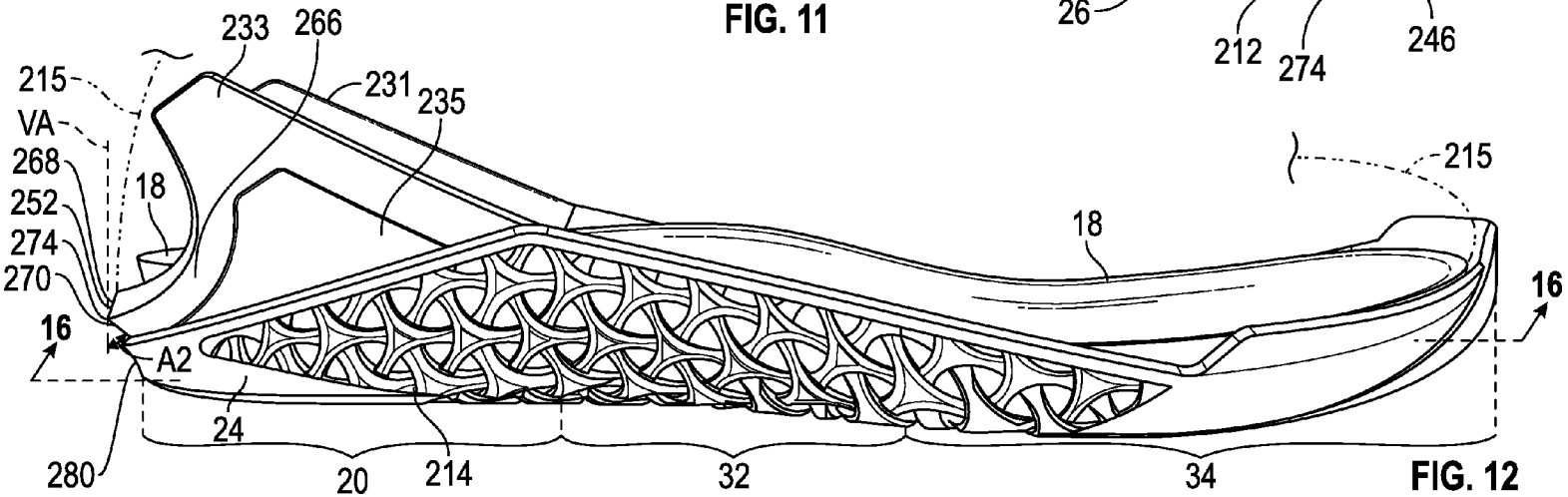
FIG. 12 is a schematic illustration in lateral side view of the article of footwear of FIG. 11 and with an upper shown partially in phantom

The upper bevel 268 slopes from the protuberance 252 to the base 272, and more specifically generally upward and forward from the ridge 274 of the protuberance 252 to the base 272 when the outsole 214 is in the position of FIGS. 11 and 12 (e.g., on a ground surface). The second bevel 270 also slopes from the protuberance 252 to the base 272, but generally rearward and forward from the ridge 274 of the protuberance 252 to the base 272 when the outsole 214 is in the position of FIGS. 11 and 12.

The beveled outer surface 266 of the protuberance 252 in the embodiment shown is bi-beveled (i.e., has two bevels 268, 270). In other embodiments, only one of the bevels may be provided. For example, if only the lower bevel 270 is provided, the rearward most extent 254 would still protrude further than the outsole 214, and would still be the only component of the article of footwear 210 in contact with the wall 62 in FIG. 6. The heel extender 228 could have any other shape at the portion that is provided in lieu of the upper bevel 268 in such an embodiment. If only the upper bevel 268 is provided, the rearward most extent 254 would still protrude further than the outsole 214, and the heel extender 228 would still be the only component of the article of footwear 210 in contact with the wall 62 in FIG. 6. The heel extender 228 could have any other shape at the portion that is provided in lieu of the lower bevel 270 in such an embodiment. In still other embodiments, a protuberance within the scope of the present teachings could have another shape without bevels, and instead could be a rounded ridge, a squared ridge, or a series of discrete protrusions arranged generally in the C-shape of the protuberance.

The outsole 214 may also have a bevel that ensures that the heel extender 228 alone contacts the wall 62 or other surface over a wide range of positions of the heel extender 228 relative to the wall 62. As is apparent in FIGS. 11, 12, and 16, the outsole 214 has a bevel 280 at the rear of the heel portion 20. In the embodiment shown, the bevel 280 extends to the medial and lateral sides 26, 24 of the outsole 214 as well. Optionally, as shown, the bevel 280 and the lower bevel 270 of the heel extender 228 extend at a common angle A2 relative to a vertical axis VA (shown in FIG. 12 and FIG. 15).

The bevel 280 reduces the thickness of the outsole 214 at the rear extremity of the outsole 214, allowing the article of footwear 210 to be tilted upward at a higher angle relative to the wall 62 in FIG. 6 without the outsole 214 contacting the wall 62 than would be possible if the outsole 214 had the full thickness at the extreme rear of the outsole 214. Because the bevel 280 extends on the medial side 26 and the lateral side 24 of the heel portion 20 as well, the range of angles and positions of the article of footwear 210 relative to the wall 62 or other surface over which the outsole 214 will not interfere with the heel extender 228 being the only portion of the article of footwear 210 in contact with the surface is increased when the medial arm 246 or lateral arm 244 of the heel extender 228 is adjacent the wall 62 rather than the rear segment 242.

Figure 17:
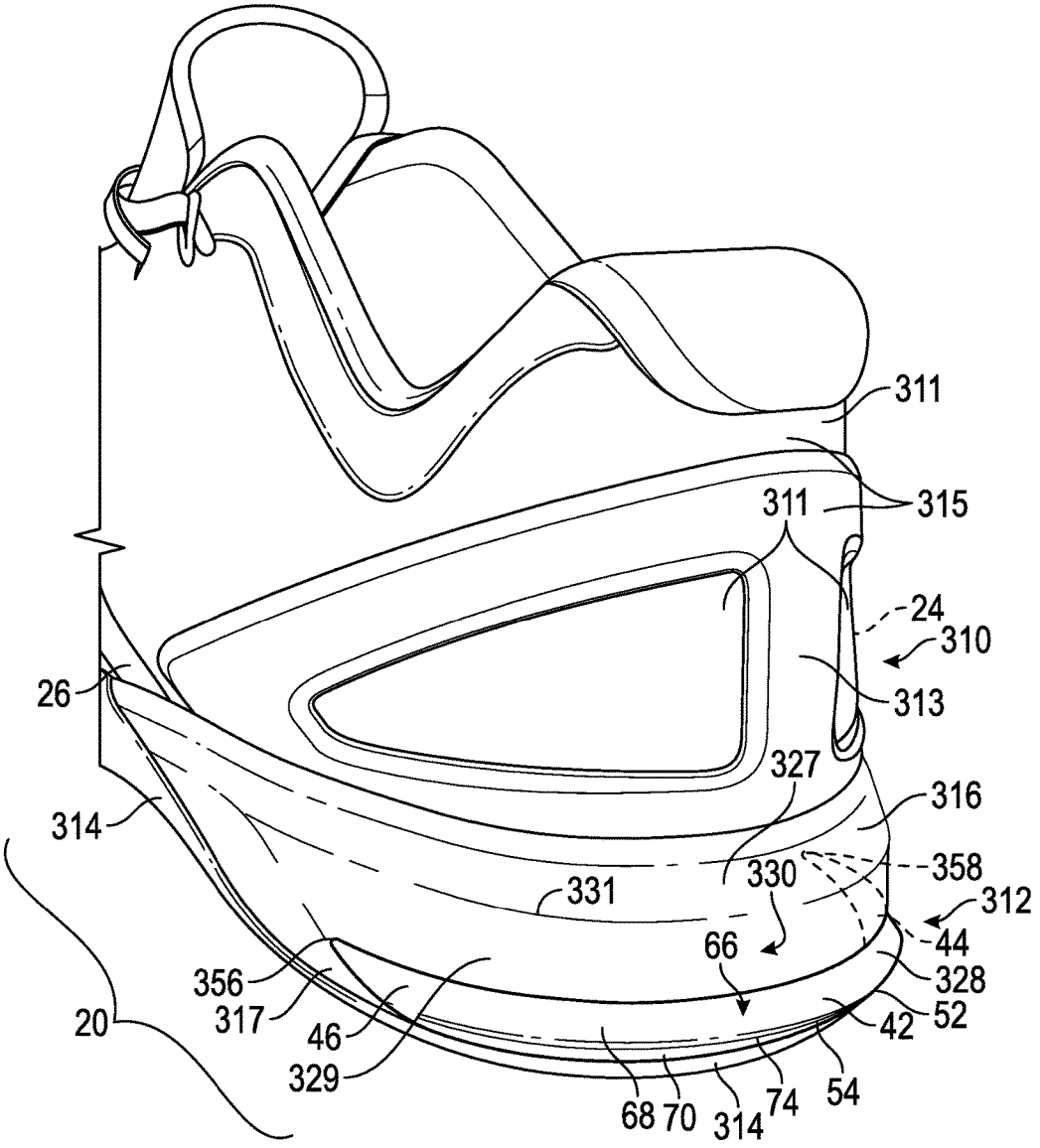
FIG. 17 is a schematic illustration in fragmentary perspective view of another embodiment of an article of footwear including a sole structure with a heel extender in accordance with an alternative aspect of the present teachings.

FIG. 17 shows another embodiment of an article of footwear 310 having many of the features of the article of footwear 10. Identical reference numbers are used for components and features that are the same as those of the article of footwear 10. The article of footwear 310 has a sole structure 312 that has a heel portion 20 with a rear, a lateral side 24, and a medial side 26. The sole structure 312 includes an outsole 314 and the drop-in inner midsole layer 18 of FIG. 3 (not shown in FIG. 17). The sole structure 312 has an outer midsole layer 316 exposed at the heel portion 20 as in the sole structure 12. An upper 315 is secured directly or indirectly to the sole structure 312 generally above the sole structure 312. In the embodiment shown, the upper 315 includes a first portion 311, that surrounds a foot and may be a knit material or other construction, and a heel plate 313 that is harder than the first portion 311 and generally supports the first portion 311 at the heel portion 20.

The article of footwear 310 includes a heel extender 328 identical to the heel extender 28 except that a taper of the lateral arm 44 and the medial arm 46 is different so that first and second ends 356, 358 are shaped differently than the ends 56, 58 of the heel extender 28. More specifically, the arms 44, 46 taper upward toward the ends 356, 358, so that a portion 317 of the outer midsole layer 316 is disposed between the heel extender 328 and the outsole 344 under each of the arms 44, 46. The heel extender 328 includes the rear segment 42, the lateral arm 44 disposed at the lateral side 24 of the heel portion 20, and the medial arm 46 disposed at the medial side 26 of the heel portion 20, with the lateral arm 44 and the medial arm 46 contiguous with the rear segment 42, and the heel extender 328 configured generally in a C-shape. The lateral arm 44 is shown with hidden lines in FIG. 17.

The heel extender 328 includes the protuberance 52 establishing the rearmost extent 54 of the article of footwear 310, and the beveled outer surface 66 with the first bevel 68 and the second bevel 70 sloping from the protuberance 52 to a base (not indicated with a reference number in FIG. 17, but identical to base 72 of FIG. 9). The continuous ridge 74 is at an apex of the protuberance 52 and extends along each of the rear segment 42, the lateral arm 44, and the medial arm 46. The protuberance 52 also establishes the furthest medial extent of the article of footwear 310 at the medial arm 46 and the furthest lateral extent of the article of footwear 310 at the lateral arm 44. Stated differently, the protuberance 52 extends rearward further than the components of the sole structure 312 and the components of the upper 315, and extends further medially and laterally at the medial and lateral arms 46, 44, respectively, than the upper 315 and the components of the sole structure 312.

The heel extender 328 may be secured to the outer surface 330 of the midsole layer 316, and may include a flange similar to flange 104 of FIG. 15 positioned between the midsole layer 316 and the outsole 314. The midsole layer 316 is molded to have an upper bevel 327 and a lower bevel 329 with a ridge 331 between the bevels 327 and 329. The entire lower bevel 329, upper bevel 327, and ridge 331 are inward of the heel extender 328. The heel extender 328 is of any of the same materials, hardnesses, and roughness as described with respect to the heel extender 28. For example, the heel extender 328 may be highly polished, with a surface roughness less than that of the components of the sole structure 312, and may have a hardness value (i.e., a second hardness) at least 44 points harder than a (first) hardness of the components of the sole structure 312 on a Shore D durometer scale.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., may be used descriptively relative to the figures, without representing limitations on the scope of the invention, as defined by the claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. An article of footwear comprising:

an upper;

a sole structure secured to the upper; wherein the sole structure includes a midsole layer and an outsole underlying the midsole layer; and a heel extender including:

a rear segment, a lateral arm, and a medial arm, both the lateral arm and the medial arm extending forward from the rear segment;

a flange extending forward from a lower extent of the rear segment;

a protuberance extending rearward along the rear segment and establishing a rearmost extent of the article of footwear;

a medial wing portion extending from the medial arm and secured to a medial side of the upper; and a lateral wing portion extending from the lateral arm and secured to a lateral side of the upper;

wherein:

the rear segment of the heel extender is secured to one of the upper and the midsole layer, with the flange disposed between the outsole and said one of the upper and the midsole layer;

the outsole includes a bottom portion below the midsole layer, a medial arch portion that extends upward from the bottom portion onto the medial side of the upper above the midsole layer, and a lateral arch portion that extends upward from the bottom portion onto the lateral side of the upper above the midsole layer;

an upper edge of the medial wing portion has a decline that continues along an upper edge of the medial arch portion; and an upper edge of the lateral wing portion has a decline that continues along an upper edge of the lateral arch portion.

2. The article of footwear of claim 1, wherein:

the lateral arm and the medial arm are contiguous with and extend from the rear segment such that the rear segment, the lateral arm, and the medial arm are configured in a C-shape.

3. The article of footwear of claim 1, wherein the outsole includes protrusions that extend outward from the bottom portion, from the medial arch portion, and from the lateral arch portion.

4. The article of footwear of claim 1, wherein:

the heel extender has an inner surface with a first concavity from the medial arm to the lateral arm, and a second concavity from an upper extent of the rear segment to the lower extent of the rear segment; and the second concavity continues along the flange.

5. The article of footwear of claim 1, wherein:

protrusions of the outsole continue from the bottom portion of the outsole upward along the medial arch portion and the lateral arch portion.

6. The article of footwear of claim 1, wherein:

the sole structure has a heel portion with a rear, a lateral side, and a medial side;

the rear segment is disposed at the rear of the heel portion, the lateral arm is contiguous with the rear segment and is disposed at the lateral side of the heel portion, and the medial arm is contiguous with the rear segment and is disposed at the medial side of the heel portion; and the sole structure has a first hardness and the protuberance has a second hardness greater than the first hardness.

7. The article of footwear of claim 1, wherein:

the protuberance defines a ridge that extends along each of the rear segment, the lateral arm, and the medial arm; and the heel extender has a beveled outer surface with an upper bevel that slopes upward from the ridge, and a lower bevel that slopes downward from the ridge, with the ridge between the upper bevel and the lower bevel.

8. The article of footwear of claim 1, wherein:

the heel extender has an inner surface with a first concavity from the medial arm to the lateral arm, and a second concavity from an upper extent of the rear segment to a lower extent of the rear segment.

9. The article of footwear of claim 1, wherein the outsole includes protrusions extending outward from the medial arch portion.

10. The article of footwear of claim 1, wherein the sole structure has a heel portion with a rear, the rear segment is disposed at the rear of the heel portion, and the outsole is the only portion of the sole structure exposed at the heel portion.

11. The article of footwear of claim 1, wherein the sole structure has a heel portion with a rear, and the heel extender is secured to the upper and the outsole at the rear of the heel portion.

12. The article of footwear of claim 1, wherein the protuberance has a first average surface roughness, and the outsole has a second average surface roughness greater than the first average surface roughness.

13. An article of footwear comprising:

an upper;

a sole structure secured to the upper; wherein the sole structure includes a midsole layer and an outsole; and a heel extender including:

a rear segment, a lateral arm, and a medial arm, both the lateral arm and the medial arm extending forward from the rear segment; and a protuberance extending rearward along the rear segment and establishing a rearmost extent of the article of footwear;

wherein:

the rear segment of the heel extender is secured to one of the upper and the midsole layer;

the protuberance defines a ridge that extends along the rear segment;

the heel extender has a beveled outer surface with an upper bevel that slopes upward from the ridge, and a lower bevel that slopes downward from the ridge, with the ridge between the upper bevel and the lower bevel;

the outsole has a bevel at a rear of a heel portion of the sole structure; and the bevel of the outsole and the lower bevel of the heel extender extend at a common angle relative to a vertical axis.

14. The article of footwear of claim 13, wherein the heel extender has a flange extending forward from a lower extent of the rear segment and disposed between the outsole and the upper.

15. The article of footwear of claim 13, wherein the outsole has a bottom portion and a medial arch portion that extends upward from the bottom portion onto a medial side of the upper.

16. The article of footwear of claim 15, wherein an upper edge of the medial arch portion slopes downwardly and forwardly.

17. The article of footwear of claim 15, wherein the medial arch portion has protrusions.

18. The article of footwear of claim 13, wherein the outsole has a bottom portion and a lateral arch portion that extends upward from the bottom portion onto a lateral side of the upper; and the lateral arch portion has protrusions.

19. An article of footwear comprising:

an upper;

a sole structure secured to the upper; wherein the sole structure includes an outsole having a bottom portion and at least one of a medial arch portion that extends upward from the bottom portion onto a medial side of the upper or a lateral arch portion that extends upward from the bottom portion onto a lateral side of the upper;

a heel extender including:

a rear segment, a lateral arm, and a medial arm, both the lateral arm and the medial arm extending forward from the rear segment, the rear segment secured to at least one of the upper or the sole structure;

a protuberance extending rearward along the rear segment and establishing a rearmost extent of the article of footwear; and at least one of a medial wing portion extending from the medial arm and secured to a medial side of the upper or a lateral wing portion extending from the lateral arm and secured to a lateral side of the upper, the medial wing portion having an upper edge with a decline that continues along an upper edge of the medial arch portion, the lateral wing portion having an upper edge with a decline that continues along an upper edge of the lateral arch portion.

20. The article of footwear of claim 19, wherein the heel extender further includes a flange extending forward from a lower extent of the rear segment, and the flange disposed between the outsole and the upper.

* * * * *